United States Patent [19]

Willcox

[11] 4,375,888

[45] Mar. 8, 1983

[54] GOLF BALL DRIVE LENGTH INDICATING APPARATUS

[76] Inventor: Leland J. Willcox, 75 Queens Dr., 7085 SE. Bloomfield Rd., Des Moines, Iowa 50320

[21] Appl. No.: 244,139

[22] Filed: Mar. 16, 1981

[51] Int. Cl.[3] ..... A63B 69/36

[52] U.S. Cl. ..... 273/184 R; 273/182 A

[58] Field of Search ..... 273/184 R, 185 R, 185 A, 273/185 B; 73/379

[56] References Cited

U.S. PATENT DOCUMENTS

| | | | |
|---|---|---|---|
| 2,054,079 | 9/1936 | Ham | 273/185 R X |
| 2,247,501 | 7/1941 | Jenks et al. | 273/181 J |
| 3,411,788 | 11/1968 | Blanding | 273/184 R X |

*Primary Examiner*—George J. Marlo

*Attorney, Agent, or Firm*—Rudolph L. Lowell

[57] ABSTRACT

The golf ball receiving apparatus includes a net structure for enclosing a liquid filled container having a flexible front wall facing an open side of the net structure and constituting a ball target. The impact force applied on the front wall displaces liquid within the container in volume amounts proportional to the magnitude of the impact force. The displaced liquid is confined for movement into an accumulator chamber associated with an operator member, movable in response to the volume of displaced liquid, and directed to actuate a transfer member which transmits the magnitude of the impact force to a drive indicating gauge or scale. After striking the target, the driven balls are directed into a receptacle that is manually movable to deliver the balls to a collection area for reuse or for feeding into a practice driving machine.

4 Claims, 7 Drawing Figures

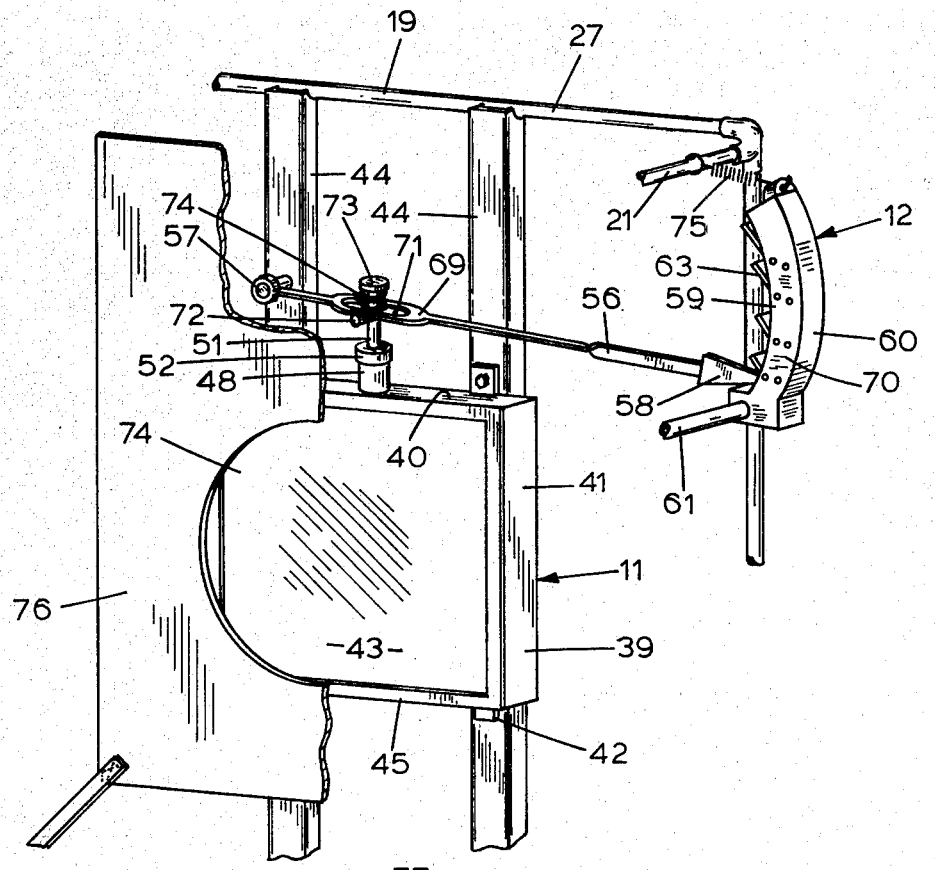
FIG. 2
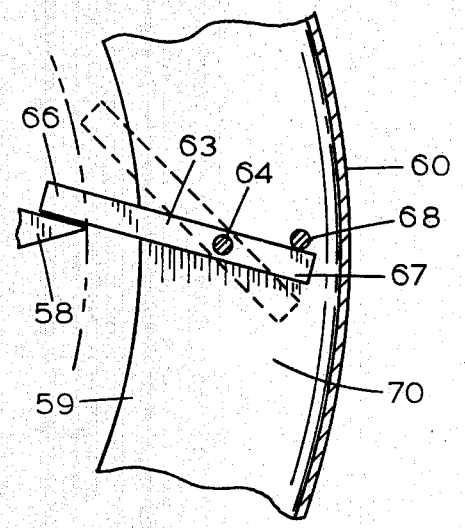
FIG. 4
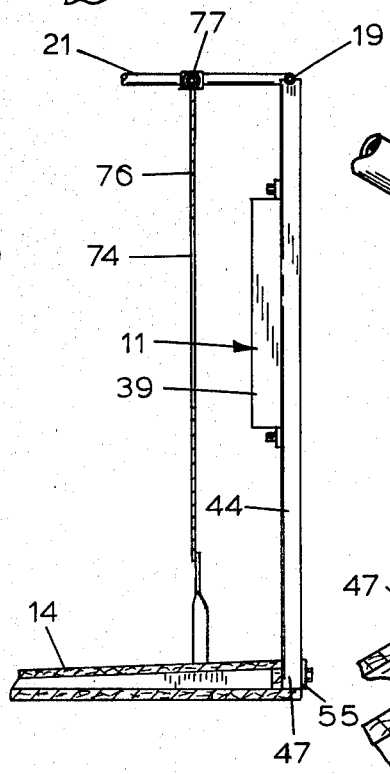
FIG. 5
FIG. 6
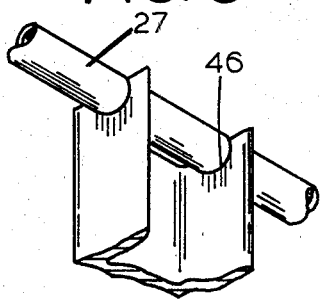
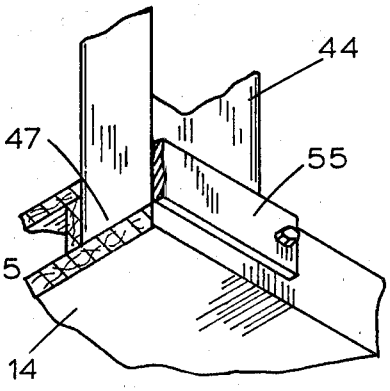

GOLF BALL DRIVE LENGTH INDICATING APPARATUS

BACKGROUND OF THE INVENTION

Apparatus for receiving practice driven golf balls are well known and usually consist of a net structure having an open side into which the ball is driven. It is of interest to the golfer to have some indication as to the accuracy and length of his practice drives. For this purpose, some of the prior art devices include a hinged target which is pivotally movable in response to the impact force applied thereon by a driven ball. The impact force is transmitted from the target to an indicating means which has a scale calibrated to indicate yardage driven corresponding to the pivotal movement of the target. Although generally satisfactory in operation, a swinging target is subject to movement by wind in either direction and to "hunting" a neutral or non-swinging position after being struck by a driven ball.

SUMMARY OF THE INVENTION

The golf ball receiving apparatus is economical in cost and efficient in use to visually indicate the accuracy of a drive and the estimated yardage covered by the drive ball. The target, at which the practice ball is directed, is stationary, directly receives the full impact of a driven ball, and is always in a condition to provide for the transmittal or transfer of uniform drive readings to a scale for indicating in yards an estimated length of the drive. All the balls are driven into a net structure, which encloses the target, for return to a common collection station for convenient accessibility to the practicing golfer, or for feeding into a golf ball practice driving machine associated with the ball receiving apparatus.

DESCRIPTION OF THE DRAWINGS

FIG. 2 is an enlarged detail perspective view of a target unit that forms part of the ball receiving apparatus shown in FIG. 1;

FIG. 4 is an enlarged sectional detail view showing a lever that forms part of a drive indicating gauge unit associated with the target unit;

FIG. 5 is a sectional view on line 5—5 in FIG. 1, showing the mounting means for the target unit;

FIG. 6 is a foreshortened enlarged perspective view of the mounting means in FIG. 5;

DESCRIPTION OF THE INVENTION

Figure 1:
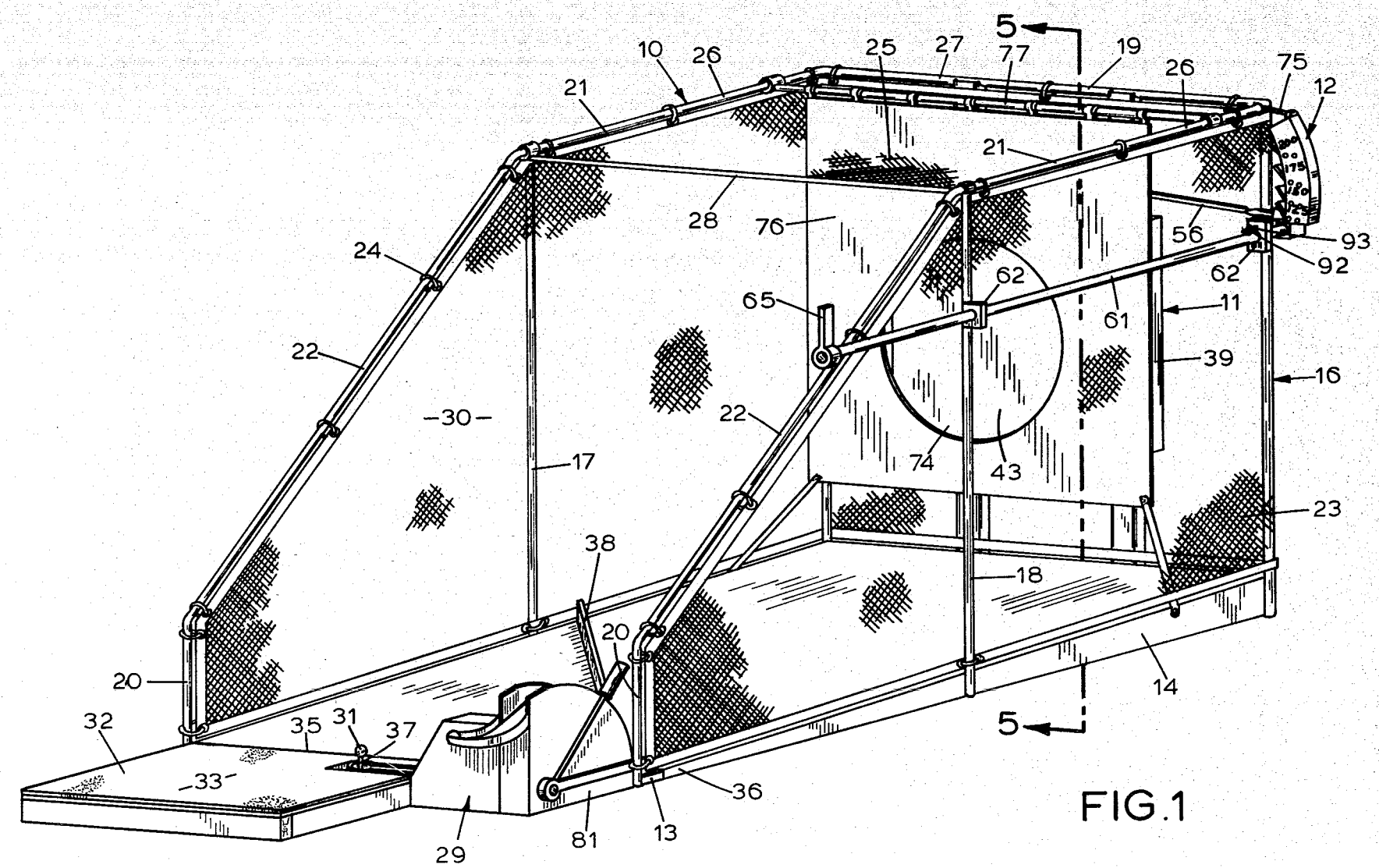
FIG. 1 is a front perspective view of the apparatus for receiving practice driven golf balls shown in assembly relation with a device for teeing up a ball to be driven.

With reference to FIG. 1, the apparatus of this invention for receiving practice driven golf balls is shown as including a net assembly indicated generally as 10, a target unit 11, a gauge 12 for indicating in yards the distance traveled by a ball driven against the target 11, and a ball collecting tray 13. The net assembly 10 has a flat forwardly inclined floor or base member 14 of a generally rectangular shape for supporting an open frame structure 16 of a tubular construction. The frame structure 16 has a pair of like transversely opposite upright side sections 17 and 18 and an upright rear section 19 extended between and connected to the rear ends of the side sections 17 and 18. Each side section 17 and 18 includes a top tubular member 21 having a downwardly and forwardly inclined front section 22 carried on upright legs 20 secured to the base member 14.

A ball confining net 23 suitably attached to the frame structure 16, as by ring members 24, encloses the side sections 17 and 18 and the rear section 19 to provide an open front side 30. To further confine a driven ball within the frame structure 16, a top net 25 attachable to the frame structure 16 is extended between and connected to the horizontal rear sections 26 of the top tubular members 21. The top net is additionally secured to a top tubular member 27 of the rear section 19 and to a transverse brace member 28 connected to the forward upright legs 20 of the side sections 17 and 18.

A golf ball driving apparatus designated generally at 29 and of a type shown in copending application Ser. No. 132,902, filed Mar. 24, 1980, is operable to automatically tee up successive balls to be driven, as indicated for a ball 31, positioned at the open front side 30 of the apparatus 10. A platform 32, on which a player stands to address the ball 31, has a top surface 33 arranged substantially level with the front side 35 of the base member 14. The ball receiving tray 13 is located forwardly of the driving apparatus 29 and adjacent one corner 36 of the base member 14. Thus a ball 31 driven from the tee member 37 and against the target unit 11 drops downwardly onto the base member 14 for rolling movement forwardly and downwardly of the base member. A deflecting wing or bar 38 is extended transversely of the base member 14 so as to guide the rolling balls toward the base member corner 36 and into the receiving tray 13.

Figure 3:
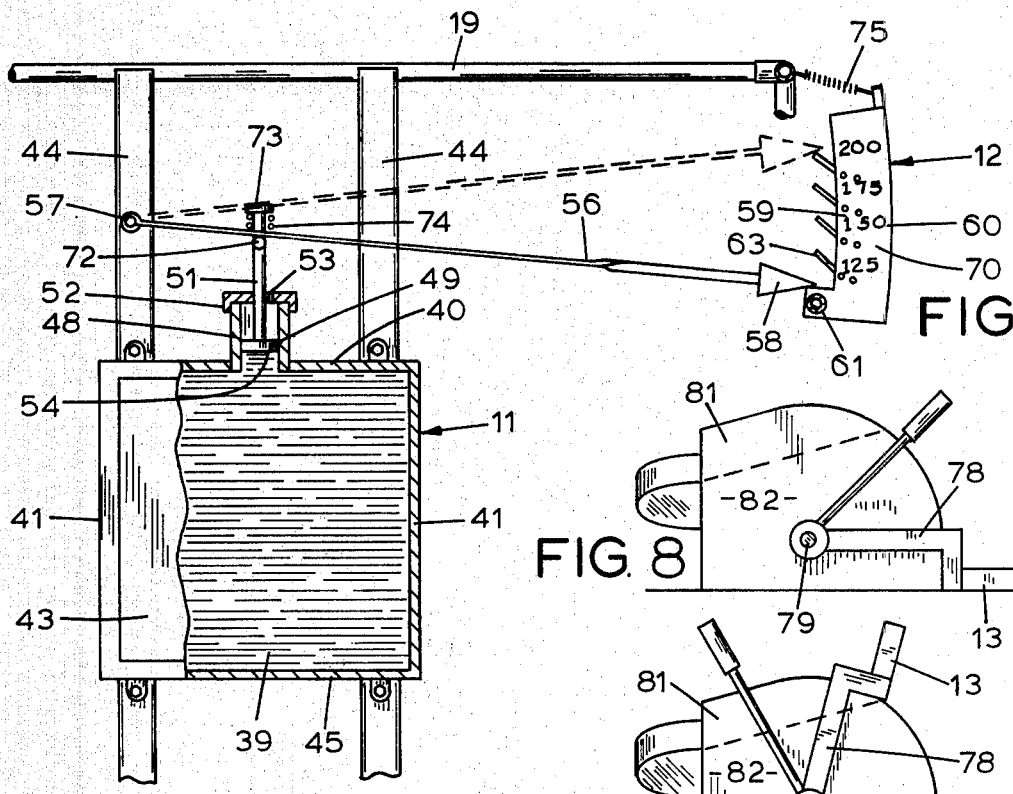
FIG. 3 is a front elevational view of the target unit shown in FIG. 2 with portions thereof broken away to more clearly show its construction.
Figure 8:
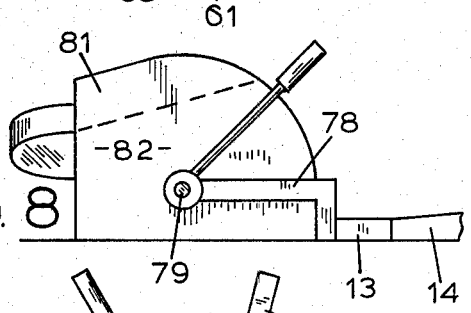
FIG. 8 is a diagrammatic illustration showing the ball collecting tray in a position for receiving retrieved balls.
Figure 9:
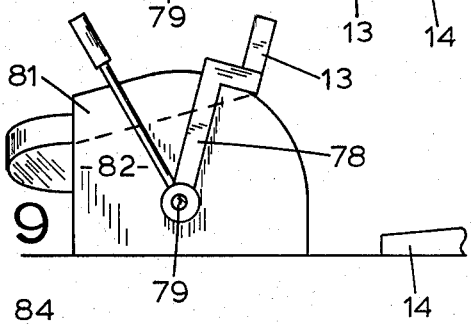
FIG. 9 is illustrated similarly to FIG. 9 and shows the ball collecting tray in a position for delivering the balls to the ball driving device.

The target unit 11 (FIGS. 1, 2 and 3) includes a liquid container 39, of a generally narrow box shape, supported in an upright position adjacent to and forwardly of the frame rear section 19. The container 39 has a top wall 40, a bottom wall 45 side walls 41 and a rear wall 42 of a rigid metal construction and front wall 43 composed of a resilient material such as reinforced rubber or plastic. In this respect, the composition of the resilient wall 43 has the characteristic of remaining substantially flat, when the container 39 is filled with liquid. Stated otherwise, the front wall presents a substantially flat target with negligible sag or bulge that might result from the pressure of the liquid within the container acting thereon.

The container 39 (FIGS. 2, 5 and 6) is rigidly supported in an upright position by the securement of its rear wall 42, to a pair of upright transversely spaced mounting members 44 secured to and extended between the upper member 28 of the rear section 19 and the rear end of the base member 14. The mounting members 44 are of a channel shape in transverse cross section and have the legs thereof notched, as shown at 46, to receive therein the tubular member 27 of the rear section 19. The lower ends of the mounting members 44 are received within associated sockets 47 formed at the rear end of the base member 14 and retained therein by locking or holding straps 55. The recesses are arranged so as to locate the target unit 11 substantially centrally of the rear section 19.

The top wall 40 of the liquid container 39 (FIGS. 2 and 3) is integrally formed with an upright cylindrical projection 48 that is open to the interior of the container 39. Associated with the cylindrical projection 48 is a piston 49 threadably secured to the lower end of a piston rod 51 that is guidably supported within a cap or cover member 52 threadably secured to the cylindrical projection 48 to close the open or upper end thereof. The cap member 52 has an air bleed 53 for a purpose to appear later.

With the cap member 52 and piston assembly removed, the cylindrical projection 48 functions as a fill spout for the container 39. With the target unit 11 in use, the container is filled with liquid to a level, shown at 54 (FIG. 3), located within the cylindrical projections 48. The cap member 52 is then replaced with the piston 49 within the cylinder 48 at the liquid level 54.

As thus far described, it is seen that any pressure applied inwardly on the front flexible wall 43 of the container results in an inward deflection of the front wall to compress the liquid within the container. As a result of this compression, liquid from the container is forced into the cylinder 48 in a volume amount substantially equal to the liquid displaced by the inward deflection of the flexible front wall 43. This displaced liquid moving into the cylinder 48 acts on the piston 49 to extend the piston rod 51 upwardly from the cylinder.

Such upward movement of the piston rod 51 is translated into a pivotal movement for an indicating needle or arrow 56. The needle 56 has one end pivoted at 57 to a mounting member 44 and its opposite or free end provided with a pointer 58 that is pivotally movable up and down across a face plate 59 that is part of an upright housing 60 for a leavage assembly of the gauge unit 12. The housing 60 is of a generally U-shape in transverse cross section (FIGS. 2 and 4) with the open side thereof facing the pointer 58 on the needle 56. The lower end of the housing is rigidly secured to a rock shaft 61 that is rotatably supported in bearing units 62 carried on the supports 20 of the side section 18. A manually actuated handle 65 on the shaft 61 is positioned forwardly of the side section 18. As viewed in FIG. 3, the housing 60 is rockable in a clockwise direction relative to the axis of the shaft 61 against the action of a spring 75 connected in tension between the upright frame member 26 of the side section 18 and the upper end of the housing 60.

A series of levers 63 are pivotally movable between the legs 70 of the housing 60 with the face plate 59 being the front face of the forward one of the legs 70. The levers 63 are carried on pivots 64 (FIGS. 2 and 4) that are spaced longitudinally of the housing 60 at predetermined calibrated positions that appear as "yards driven" on the face plate 59. Each lever 63 has an end section 66 thereof projected outwardly from the housing 60 and into the path of pivotal movement of the needle point 58 for engagement therewith. Such outer end section 66 of each lever is of a length of weight to overbalance the inner end section 67 of the lever to a stop position defined by a stop pin 68 or like abutment carried between the legs 70 at a position such that each lever outer section 66 is normally inclined laterwardly outwardly and upwardly from the face plate 59. On upward movement of the needle 58, therefore, each lever outer end section 66, on engagement with the needle and as viewed in FIG. 4, is pivotally moved upwardly concurrently with a downward movement of the inner end section 67 away from the stop pin 68 to permit upward movement of the pointer 58 to an uppermost moved position. When the uppermost or maximum moved position of the needle pointer 58 is reached, the downward movement of the needle 56 is arrested or stopped by engagement of the needle point 58 with the first lever 63 therebelow. The calibration associated with such engaged lever thus indicates the extent of the needle movement and estimated or calibrated yards traveled by the ball striking or impacting against the flexible front wall 43 of the container 39.

To move the needle 56 in response to such ball impact force, the needle is formed with a flat portion 69 (FIG. 2) having an elongated slot 71 for receiving therethrough the upper end of the piston rod 51. A crossarm 72 on the piston rod is engageable with the underside of the flat portion 69 and a threaded head member 73 on the piston rod is engageable with the upper side of the needle flat portion 69. The needle is yieldably held against the cross pin 72 by a spring 74 mounted about the rod in compression between the portion 69 and cap member 73.

It is seen, therefore, that on inward deflection of the resilient front wall 43, by the impact force of the driven golf ball 31, the resultant volume displacement from the container 11 into the cylinder 48 moves the piston rod 51 upwardly and, in turn, the pointer 58 upwardly along the face plate 59. The air bleed 53 substantially eliminates any build up of an air pressure within the cylinder 48 that would impede the upward movement of the piston 49 in response to liquid displacement from the container 39.

The target area on the front wall 43 is defined by a circular opening 74 formed in a flexible sheet material 76 supported in an upright position transversely of the net assembly 10 between the side sections 17 and 18 (FIGS. 1 and 5). The sheet 76 is suspended from the tubular member 77 connected to the upper members 26 of the side sections 17 and 18. Along with defining a target area, the sheet 76 functions to deaden any ball driven thereagainst from being richocheted outwardly from the open front side of the net assembly. Thus, all driven balls 31 are arrested for substantial immediate dropping onto the base member 14 whether or not they strike the target area on the front wall 43 or the sheet 76.

Figure 7:
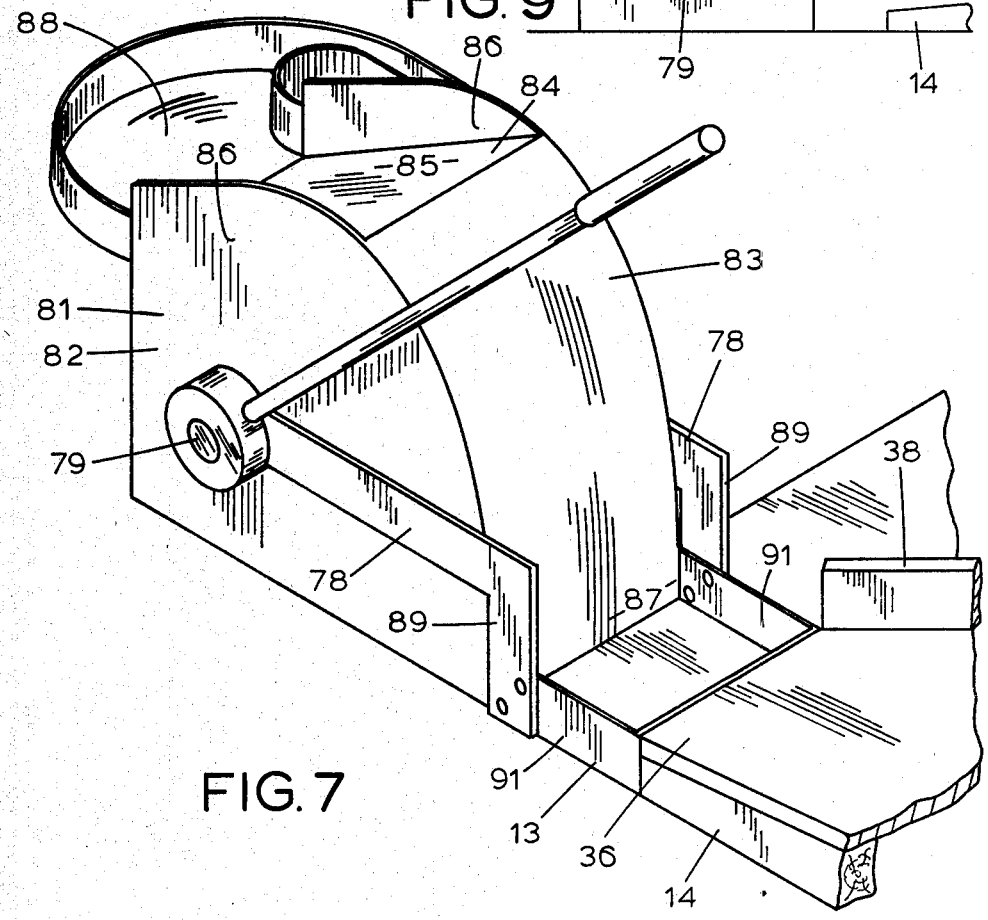
FIG. 7 is an enlarged perspective view of a tray for collecting balls retrieved by the ball receiving apparatus of FIG. 1, and for delivering the balls so collected to the ball driving device.

The balls dropping on the base member 14 are directed by the deflecting bar 38 into the ball collecting tray 13 (FIG. 7). The tray 13 is carried on and projects outwardly from the free ends of a pair of rock arms 78 axially spaced on a rock shaft 79 that is rotatably supported on a ball transfer housing 81 comprised of a pair of side members 82 and an arcuate end wall 83 which terminates in a laterally extended top wall 84 located between the upper ends 86 of the side walls 81 so as to form a trough 85 therewith. The tray 13 has an open side 87 movable in a following relation with the arcuate end wall 83, on rotation of the shaft 79, to an upright top position over the top wall 84. At such top position, the golf balls collected in the tray 13 are tipped downwardly therefrom into the trough 85 for gravity travel into a chute 88 for delivery into the golf ball driving apparatus 29. In its travel of the tray 13, the balls therein are retained on the arcuate end wall 83 by lateral extensions 89 on the rock arms 78 that are suitably secured to the tray side walls 91, at the opposite side 87 thereof.

In use, when a ball 31 is driven through the opening 74 in the sheet 76 and against the resilient front wall 43 of the container 39, the impact force thereof is indicated on the gauge 12 as estimated yards covered by the ball. After such indication has been observed, the needle 56 is returned to its lowermost position by merely rotating the rock shaft 61 (FIG. 1) in a clockwise direction, against the action of the spring 75, to move the levers 63 of the gauge 12 out of engaging positions with the needle point 58. On return of the needle 56 to its lowermost position, the gauge 12 is returned to its normal rest position by the spring 75, with the rest position being defined by the engagement of a radial pin 92 thereon with an abutment member 93 on a bearing unit 62.

Although the invention has been described with respect to a preferred embodiment thereof, it is to be understood that it is not to be so limited since changes and modifications can be made therein which are within the full intended scope of this invention as defined by the appended claims.

I claim:

1. Apparatus for indicating the drive length of a practice driven golf ball comprising:

(a) an upright net supporting frame structure having a rear section and a pair of side sections projected forwardly in a transversely spaced relation from opposite ends of said rear section, (b) means on the rear section for having applied thereto the impact forces of a driven golf ball including a liquid filled container having only a front wall formed of a resilient material, (c) means on the frame structure for visually indicating in linear length the magnitude of the impact force applied on said front wall by a driven golf ball, (d) chamber means on the container having one side thereof exposed directly to the liquid in said container for receiving liquid displaced from the container by the impact force of a driven golf ball against the front wall thereof, and (e) means movable directly in response to the volume of displaced liquid received in said chamber means through the one side thereof for transmitting to said indicating means the magnitude of the impact force.

2. The apparatus according to claim 1, wherein:

(a) said visual indicating means includes a gauge unit having a graduated face plate supported on one of said side sections, and an elongated indicator member having one end pivotally supported on said frame structure and an opposite end thereof movable across the graduated face plate, (b) said chamber means comprises a cylindrical housing, and (c) said movable means includes a piston member within said cylindrical housing and means adjacent the one end of the indicator member connecting said indicator member to said piston member for movement of the opposite end thereof across said graduated face plate by said piston member.

3. The apparatus according to claim 2, wherein:

(a) said face plate graduations are calibrated to indicate the magnitude of the impact force acting on the indicator member in yards traveled by the ball effecting the impact force.

4. The apparatus according to claim 2, including:

(a) means on said usage unit for releasably locking the indicator member at the farthest moved position thereof in response to the maximum movement of said piston member by the displaced liquid, and (b) manually actuated means on said frame structure for releasing said locking means.

* * * * *